US009427741B2

(12) United States Patent
Biggin

(10) Patent No.: US 9,427,741 B2
(45) Date of Patent: Aug. 30, 2016

(54) TWO OIL CHAMBER COUNTERWEIGHT

(71) Applicant: Metso Minerals Industries, Inc., Waukesha, WI (US)

(72) Inventor: David Francis Biggin, Burlington, WI (US)

(73) Assignee: Metso Minerals Industries, Inc., Waukesha, WI (US)

( * ) Notice: Subject to any disclaimer, the term of this patent is extended or adjusted under 35 U.S.C. 154(b) by 299 days.

(21) Appl. No.: 14/297,749

(22) Filed: Jun. 6, 2014

(65) Prior Publication Data

US 2015/0352556 A1 Dec. 10, 2015

(51) Int. Cl.
*B02C 2/04* (2006.01)

(52) U.S. Cl.
CPC *B02C 2/042* (2013.01); *B02C 2/04* (2013.01)

(58) Field of Classification Search
CPC ..... B02C 2/00; B02C 2/02; B02C 2/04; B02C 2/042
USPC ..... 241/207–216
See application file for complete search history.

(56) References Cited

U.S. PATENT DOCUMENTS

| | | | |
|---|---|---|---|
| 3,692,249 A | 9/1972 | Decker et al. | |
| 3,771,735 A | 11/1973 | Decker et al. | |
| 4,179,076 A | 12/1979 | Barrot et al. | |
| 5,762,274 A | 6/1998 | Jacobson | |
| 7,566,018 B1 | 7/2009 | Brown et al. | |
| 8,240,587 B2 * | 8/2012 | Gunnarsson | B02C 2/04 241/216 |
| 2011/0006143 A1 | 1/2011 | Gunnarsson et al. | |
| 2012/0006918 A1 | 1/2012 | Belotserkovskiy | |
| 2012/0223171 A1 | 9/2012 | Flath et al. | |
| 2014/0224909 A1 * | 8/2014 | Ha | B02C 2/04 241/209 |

FOREIGN PATENT DOCUMENTS

| | | |
|---|---|---|
| EP | 0 050 090 A2 | 4/1982 |
| WO | 2010/053747 A2 | 5/2010 |

OTHER PUBLICATIONS

PCT International Search Report and Written Opinion mailed Sep. 18, 2015.

* cited by examiner

*Primary Examiner* — Faye Francis
(74) *Attorney, Agent, or Firm* — Andrus Intellectual Property Law, LLP

(57) ABSTRACT

A counterweight for use in a cone crusher that includes an inner oil chamber and an outer oil chamber to collect lubricating oil during operation of the cone crusher. The counterweight includes a vertical separating wall that receives a splash shield. The vertical separating wall and splash shield define an inner oil chamber while an outer oil chamber is defined by the splash shield, the vertical separating wall and an inner wall of the counterweight. Both the inner and outer oil chambers include drain holes that allow lubricating oil to pass through a generally horizontal floor of the counterweight. The combination of the inner and outer oil chambers allows oil to quickly exit the counterweight into the main oil sump and reduces the amount of oil that gets exposed to the upper seal assembly which reduces the passage of oil past seal assemblies formed in the cone crusher.

20 Claims, 8 Drawing Sheets

TWO OIL CHAMBER COUNTERWEIGHT

BACKGROUND

The present disclosure generally relates to rock crushing equipment. More specifically, the present disclosure relates to a cone crusher including a counterweight that rotates along with an eccentric and includes two separate oil chambers.

Rock crushing systems, such as those referred to as cone crushers, generally break apart rock, stone or other material in a crushing gap between a stationary element and a moving element. For example, a conical rock crusher is comprised of a head assembly including a crushing head that gyrates about a vertical axis within a stationary bowl indirectly attached to a main frame of the rock crusher. The crushing head is assembled surrounding an eccentric that rotates about a fixed main shaft to impart the gyrational motion of the crushing head which crushes rock, stone or other material in a crushing gap between the crushing head and the bowl. The eccentric can be driven by a variety of power drives, such as an attached gear, driven by a pinion and countershaft assembly, and a number of mechanical power sources, such as electrical motors or combustion engines.

The exterior of the conical crushing head is covered with a protective or wear-resistant mantle that engages the material that is being crushed, such as rock. stone, or other material. The bowl, which is indirectly mechanically fixed to the main frame, is fitted with a bowl liner. The bowl liner and bowl are stationary and spaced from the crushing head. The bowl liner provides an opposing surface from the mantle for crushing the material. The material is crushed in the crushing gap between the mantle and the bowl liner.

The gyrational motion of the crushing head with respect to the stationary bowl crushes rock, stone or other material within the crushing gap. Generally, the rock, stone or other material is fed onto a feed plate that directs the material toward the crushing gap where the material is crushed as it travels through the crushing gap. The crushed material exits the crushing chamber through the bottom of the crushing gap. The size of the crushing gap determines the maximum size of the crushed material that exits the crushing gap.

In currently available cone crushers, a supply of lubricating oil is directed to the bushing located between the eccentric and the stationary main shaft and to the bushing located between the head assembly and the eccentric. The lubricating oil drains through holes that are formed in the crushing head and eventually drops onto a moving counterweight that is attached to the eccentric. As the rotational speed of the eccentric and the attached counterweight increases, oil is flung around the interior of the counterweight. Some of this oil may escape out through seals within the cone crusher, which can result in the need for replacing the lost oil.

The counterweight has two main functions in a cone crusher. First, the counterweight functions to balance the centrifugal forces of the head and eccentric. Second, the counterweight functions to create a path and seal oil between the gyrating head and the stationary main frame.

Often, positive pressure air is added to the internals of the cone crusher to keep dust from being pulled in through the seals. The positive air pressure can amplify oil leakage in current designs.

SUMMARY

The present disclosure relates to a counterweight for use in rock crushing equipment, such as a cone crusher. The counterweight includes two separate oil chambers that receive lubricating oil and direct the lubricating oil to an oil sump.

The counterweight of the present disclosure is for use with a cone crusher that includes a stationary bowl. A head assembly is positioned for movement within the stationary bowl to create a crushing gap between the stationary bowl and the head assembly. The head assembly includes a crushing head and mantle. The head assembly is received around an eccentric that is in turn rotatable about a stationary main shaft. The configuration of the eccentric causes the head assembly to gyrate within the stationary bowl upon rotation of the eccentric around the main shaft.

The counterweight constructed in accordance with the present disclosure is mounted to the eccentric and rotates with the eccentric. The counterweight includes both an inner oil chamber and an outer oil chamber that each receive lubricating oil and direct the lubricating oil to a main oil sump of the cone crusher.

The eccentric includes a generally horizontal floor that extends from an inner edge to an outer edge. A vertical separating wall extends from the generally horizontal floor and is positioned at a location between the inner edge and the outer edge. The vertical separating. wall separates the inner oil chamber from the outer oil chamber.

A splash shield is mounted to the vertical separating wall and is positioned to overhang at least a portion of the horizontal floor that is radially inward from the vertical separating wall. The splash shield further separates the inner oil chamber from the outer oil chamber and defines an upper barrier for the inner oil chamber as well as a lower barrier for the outer oil chamber. In one embodiment of the disclosure, the splash shield is formed from a plurality of shield plates that are each separately attached to the vertical separating wall. The splash shield extends around the entire internal circumference of the counterweight such that the inner oil chamber also extends around the entire circumference of the counterweight. The inner oil chamber includes a plurality of spaced inner chamber drain holes that allow oil to pass through the floor of the counterweight.

The counterweight further includes an outer oil chamber that is formed between the vertical separating wall and an inclined inner wall of the counterweight. The outer oil chamber is spaced radially outward relative to the inner oil chamber and separated from the inner oil chamber by the vertical separating wall and the splash shield. The outer oil chamber includes a plurality of spaced outer chamber drain holes that allow oil to pass from the outer oil chamber through the counterweight floor and into the main sump of the cone crusher. The outer chamber also extends the circumference of the counterweight.

An outer end of the splash shield is attached to the separating wall while an inner end of the splash shield is closely spaced to an outer surface of the crushing head. The small gap created between the crushing head and the inner end of the splash shield entraps most of the drained lubricating oil within the inner oil chamber. The portion of oil or oil mist that escapes through the gap between the splash shield and the crushing head is directed into contact with a head skirt. The head skirt is positioned to direct oil or the oil mist away from the seal between the counterweight and the crushing head such that the oil can be drained from the counterweight through the drain holes formed in the outer oil chamber.

The combination of the inner and outer oil chambers collects and drains the lubricating oil and prevents the lubricating oil from passing through the seal assemblies between the counterweight and the crushing head. The splash shield that forms a part of the inner oil chamber quickly directs most of the oil into the sump and greatly reduces the amount of oil that contacts the inclined inner wall of the counterweight, thereby reducing the amount of oil loss. The splash shield is constructed of multiple shield plates such that the splash shield can be easily assembled within the interior of the counterweight.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
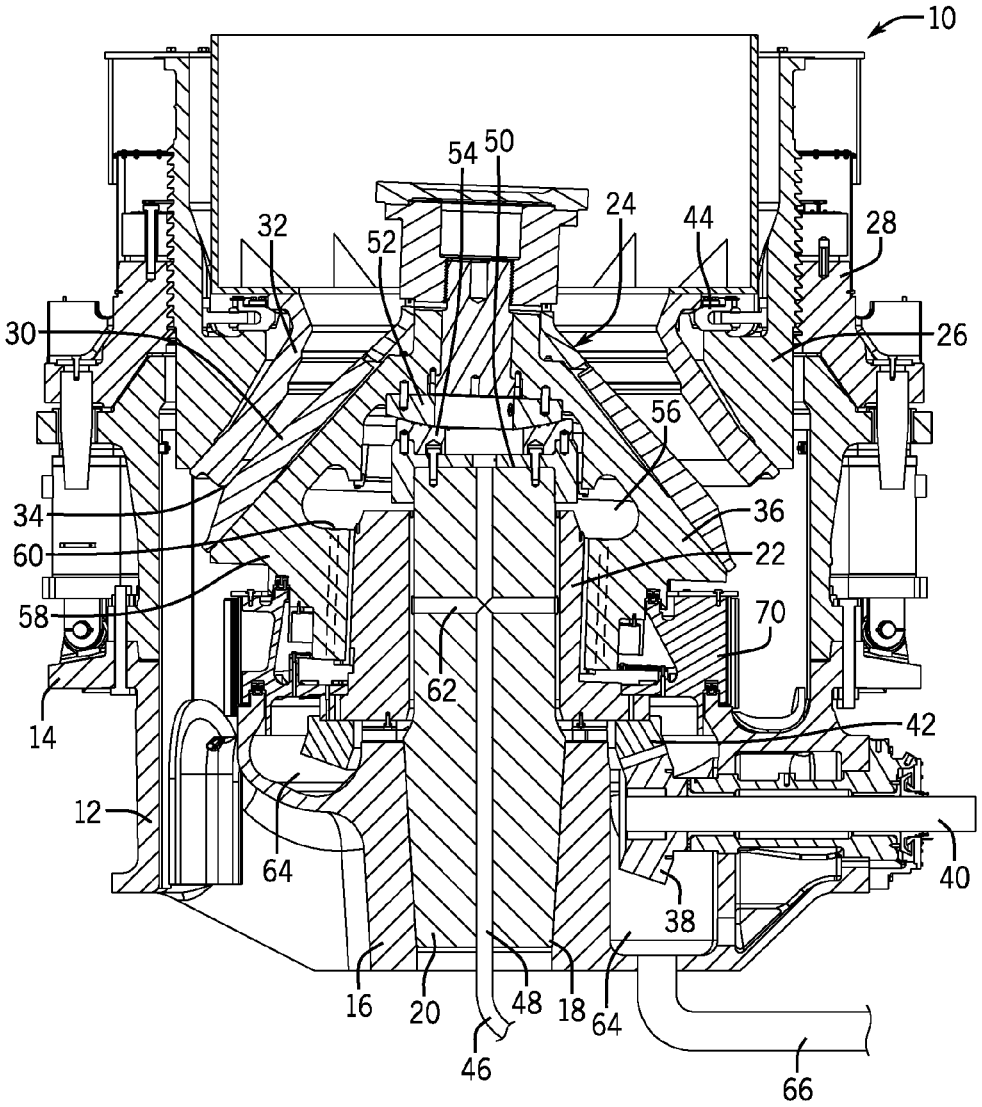
FIG. 1 is a section view of a cone crusher incorporating the counterweight of the present disclosure.

FIG. 1 illustrates a section view of a cone crusher 10 that is operable to crush material, such as rock, stone, ore, minerals or other substances. The cone crusher 10 includes a main frame 12 having a mounting flange 14. The cone crusher 10 can be any size rock crusher or include any type of crusher head. Mounting flange 14 rests upon a platform-like foundation that can include concrete piers (not shown), a foundation block, a platform or other supporting member. A central hub 16 of the main frame 12 includes an upwardly diverging vertical bore or tapered bore 18. The bore 18 is adapted to receive a main shaft 20. The main shaft 20 is held stationary in the bore 18 with respect to the central hub 16 of the frame 12.

The main shaft 20 radially supports an eccentric 22 that surrounds the main shaft 20. The head assembly 24 is supported on the top end of the main shaft 20. The eccentric 22 rotates about the stationary main shaft 20, thereby causing the head assembly 24 to gyrate within the cone crusher 10. Gyration of the head assembly 24 within a bowl 26 that is directly fixed to an adjustment ring 28 supported by the main frame 12 allows rock, stone, ore, minerals or other materials to be crushed between a mantle 30 and a bowl liner 32. The gyrational motion of the head assembly 24 crushes rock in a crushing gap 34 and the force of gravity causes additional material to move toward the crushing gap 34. The bowl liner 32 is held against the bowl 26 by a wedge 44 and the mantle 30 is attached to a crushing head of the head assembly 24. The gyrational movement of the head assembly 24 forces the mantle 30 toward the bowl liner 32 to create the rock crushing force within the crushing gap 34.

As can be understood in FIG. 1, when the cone crusher 10 is operating, drive shaft 40 rotates the eccentric 22 through the interaction between the pinion 38 and the gear 42. Since the outside diameter of the eccentric 22 is offset from the inside diameter, the rotation of the eccentric 22 creates the gyrational movement of the head assembly 24 within the stationary bowl 26. The gyrational movement of the head assembly 24 changes the size of the crushing gap 34 which allows the material to be crushed to enter into the crashing gap. Further rotation of the eccentric 22 creates the crushing force within the crushing gap 34 to reduce the size of particles being crushed by the cone crusher 10. The cone crusher 10 can be one of many different types of cone crushers available from various manufacturers, such as Metso Minerals of Waukesha, Wis. As an example, the cone crusher 10 shown in FIG. 1 can be an MP® series rock crusher, such as the MP®2500 available from Metso Minerals. However, different types of cone crushers could be utilized while operating within the scope of the present disclosure.

During operation of the cone crusher 10, material is crushed by the gyrating movement of the head assembly 24 in the crushing gap 34 formed between the outer surface of the mantle 30 and the bowl liner 32. Both the bowl liner 32 and the mantle 30 are designed as replaceable equipment such that the cone crusher can be refurbished upon wear.

The cone crusher 10 includes an oil lubrication system that provides a supply of lubricating oil between the moving components within the cone crusher. The lubrication system includes an inlet 46 that receives a supply of lubricating oil. The inlet 46 directs lubricating oil to a central passage 48 that extends through the center of the main shaft 20. The central passage 48 extends to the top end 50 of the main shaft 20 where the oil leaves the main shaft 20 and lubricates the gyrational point of contact between the head ball 52 and the socket liner 54. The lubricating oil distributed through the top end 50 of the main shaft 20 pools within an upper sump 56 and passes through the lower portion 58 of the crushing head 36 through a series of drain holes 60.

In addition to the central passage 48, the main shaft 20 includes a radial passage 62 that distributes lubricating oil between the rotating eccentric 22 and the main shaft 20 and between the crushing head 36 and the eccentric.

The lubricating oil passes through the crushing head 36 and is collected within a main frame oil sump 64, which in turn is drained through a lubrication outlet 66. The lubrication outlet 66 directs the lubricating oil back to a pumping, cooling and filtering system where the lubricating oil is filtered and supplied back to the inlet 46 for redistribution within the cone crusher.

Figure 2:
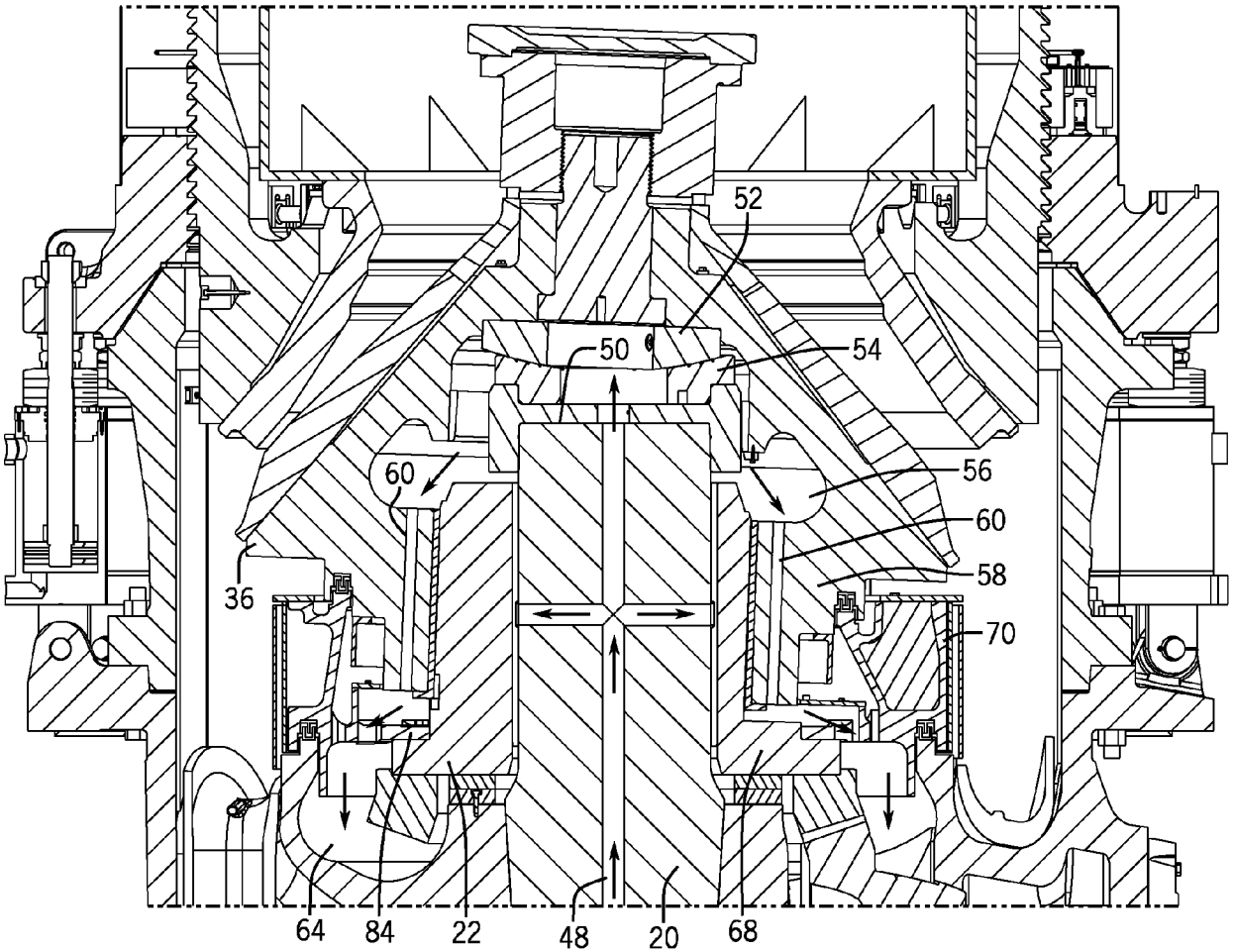
FIG. 2 is a magnified section view similar to FIG. 1 illustrating the flow of lubricating oil within the cone crusher.

FIG. 2 illustrates the flow of lubricating oil through the central passageway 48, as illustrated by a series of arrows. As described, the lubricating oil exits the top end 50 of the main shaft 20 and lubricates the head ball 52 and socket liner 54. There is also oil from end leakage from the eccentric to the main shaft bushing and crushing head to the eccentric bushing. The oil then flows into the upper sump 56. The oil collected within the upper sump 56 passes through the series of drain holes 60 formed in the lower portion 58 of the crushing head 36. The oil leaving the lower end of each of the drain holes 60 falls onto a radial flange 68 of the eccentric 22 or onto the floor 84 of the counterweight 70.

Since the eccentric 22 is rotating at a relatively high rate of speed, oil falling onto the radial flange 68 is flung radially outward and into contact with the counterweight 70 that is securely attached to and rotatable with the eccentric 22. In accordance with the present disclosure, the counterweight 70 includes a pair of oil chambers, to be described below, that each include separate drain holes that allow the oil to pass through the counterweight and be collected Within the main frame oil sump 64.

Figure 10:
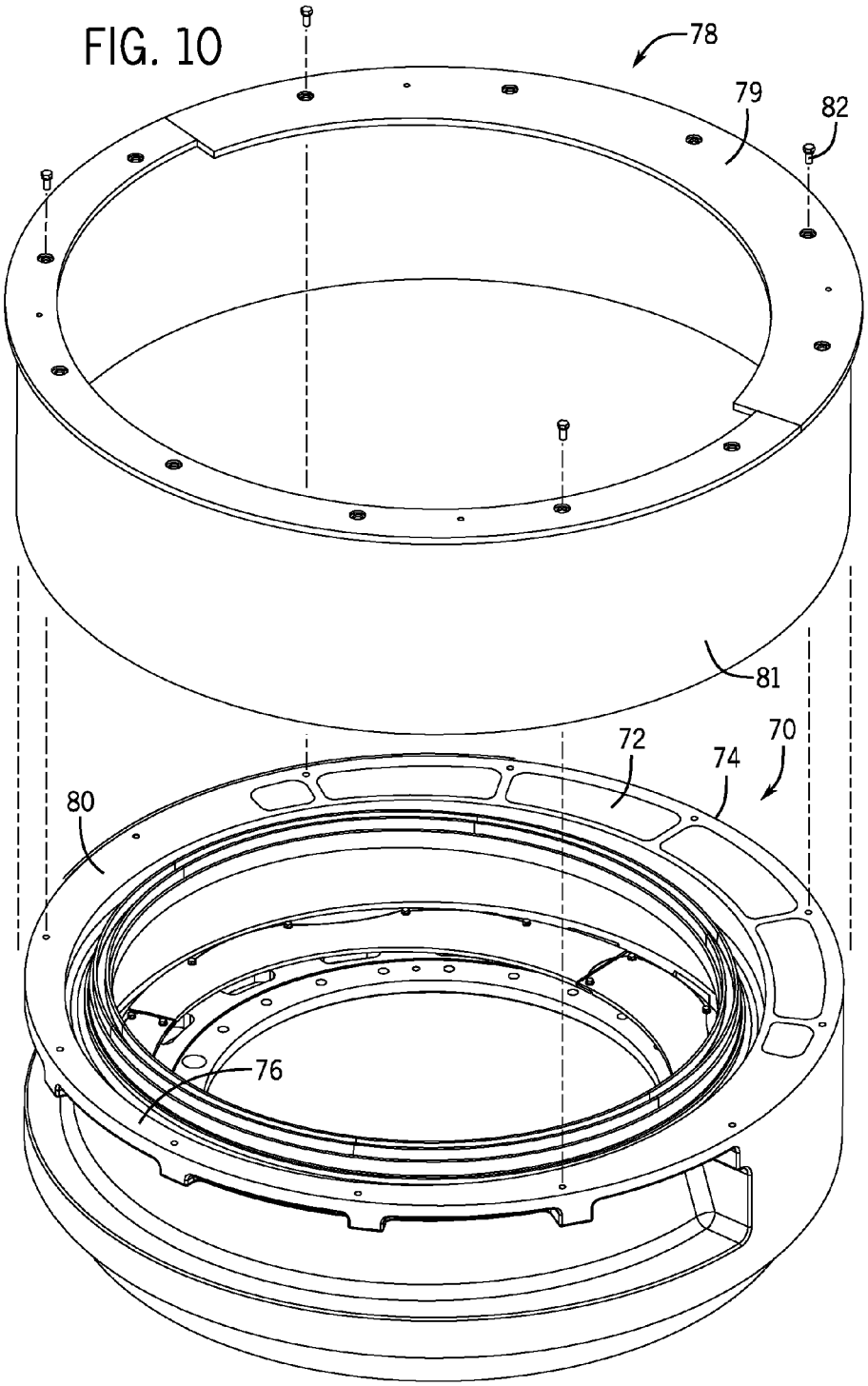
FIG. 10 is an isometric view illustrating the counterweight.

FIG. 10 is an isometric, view of the counterweight 70 constructed in accordance with the present disclosure. The counterweight 70 is a generally cylindrical component that is mounted to the eccentric for rotation with the eccentric. The counterweight assembly 70 balances the eccentric and crushing head. The counterweight 70 includes a series of tanks 72 formed on a heavy side 74 of the counterweight. The light side 76 of the counterweight does not include any tanks. When the counterweight 70 is mounted to the eccentric, the heavy side 74 is aligned with the thin side of the eccentric while the light side 76 of the counterweight 70 is aligned with the thick side of the eccentric. The series of tanks 72 are typically filled with dense material, such as lead or tungsten rods, to provide the required weighting for the heavy side 74. A cover 78 is attached to the upper surface 80 of the counterweight 70 through a series of individual fasteners 82. The cover 78 is attached to the counterweight 70 after each of the tanks 72 are filled with the weighted material to protect the counterweight 70 from wear. In the embodiment shown in FIG. 10, the cover 78 is formed from welding a flat top plate 79 to a depending cylindrical bottom plate 81. However, the cover 78 could be formed as a complete, unitary component.

Figure 8:
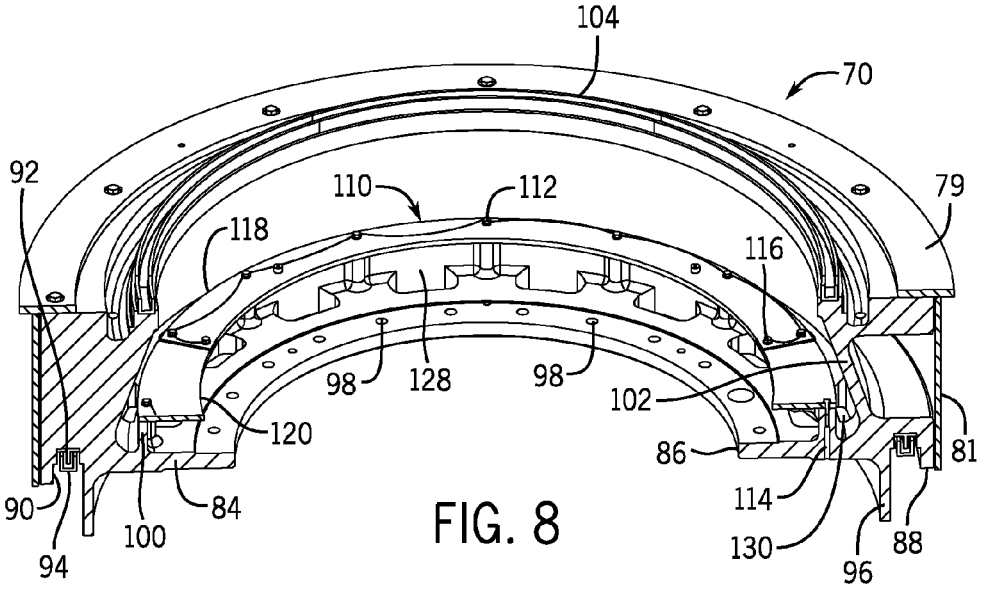
FIG. 8 is a top section view of the counterweight.
Figure 9:
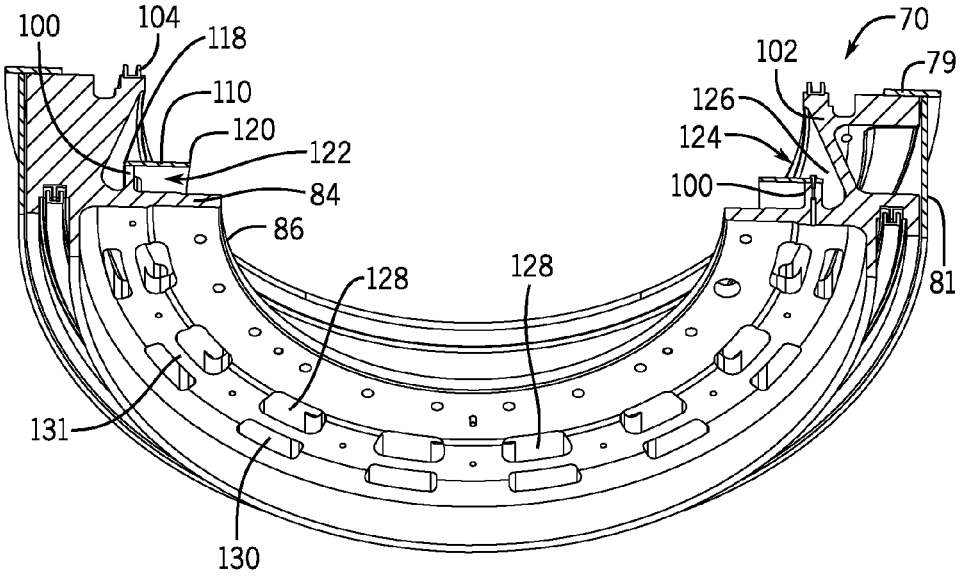
FIG. 9 is a bottom section view of the counterweight.

FIGS. 8 and 9 are upper and lower cross-sectional views of the counterweight 70. As can be seen in FIG. 8, the counterweight 70 includes a generally horizontal floor 84 that extends radially outward from an inner edge 86 to an outer edge 88. A recessed mounting groove 90 is formed in the floor 84 and receives a T-seal 92, which in turn is received within a U-seal 94 mounted to the main frame . The counterweight further includes a lower vertical flange 96 that extends vertically below the floor 84.

The horizontal floor 84 includes a series of attachment holes 98 positioned near the inner edge 86. The attachment holes 98 allow the entire counterweight 70 to be attached to the eccentric for rotation with the eccentric.

Figure 5:
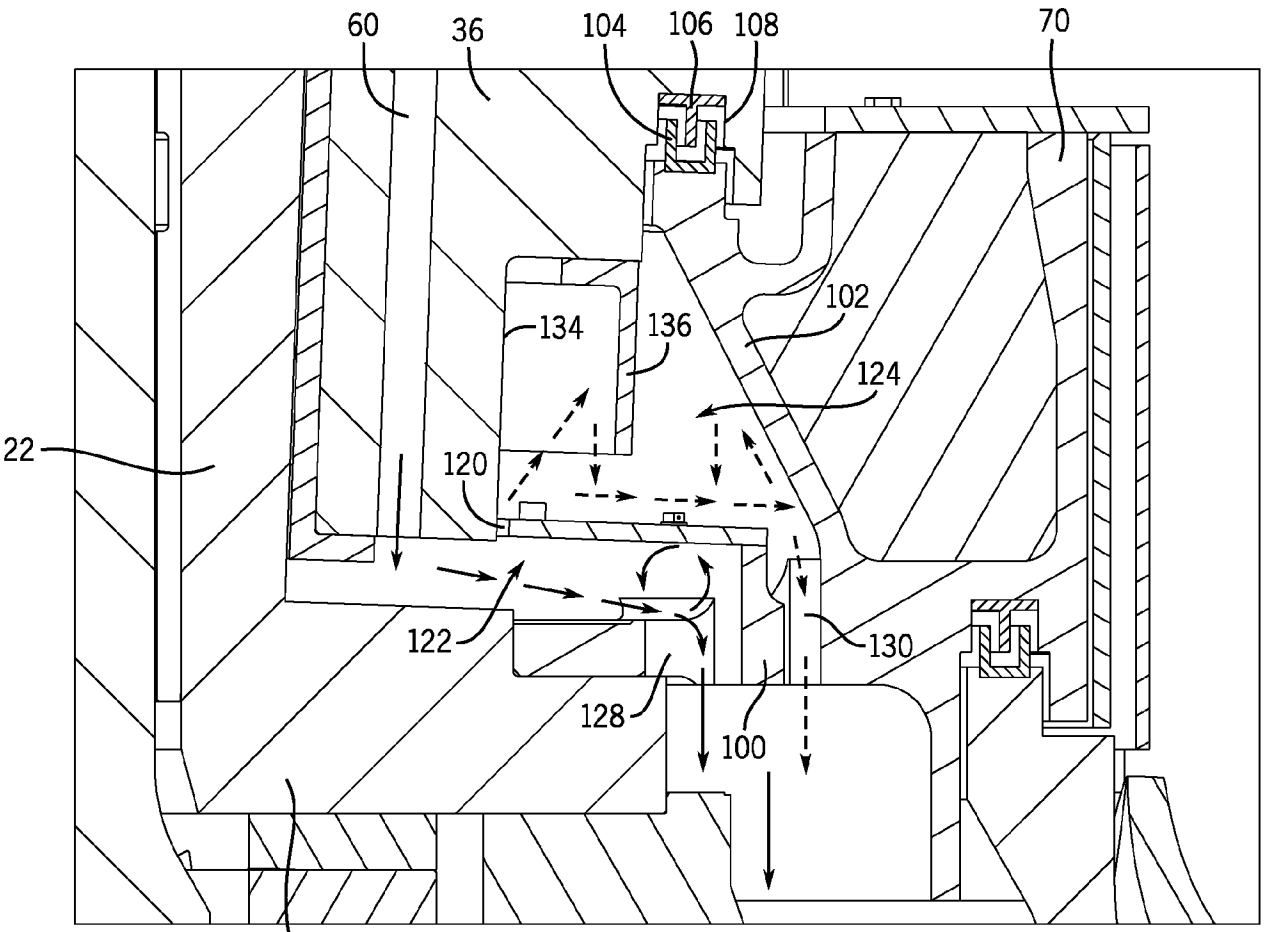
FIG. 5 is a view similar to FIG. 4 showing the movement of oil within the inner and outer oil chambers of the counterweight.

The counterweight 70 further includes a vertical separating wall 100 that extends upward from the horizontal floor 84 at a location between the inner edge 86 and an inner wall 102. As illustrated in FIG. 8, the inner wall 102 extends both upwardly and inwardly relative to the horizontal floor 84. The inner wall 102 defines the height of the counterweight and supports a U-seal 104, as best illustrated in FIG. 9. The U-seal 104 interacts with a mating T-seal 106 formed in a groove 108 formed in the crushing head 36, as best shown in FIG. 5.

Referring back to FIG. 8, a splash shield 110 is mounted to the vertical separating wall 100 and extends over a portion of the horizontal floor 84. In the embodiment illustrated, the splash shield 110 is formed from multiple sections that are joined to each other. The use of multiple sections to form the splash shield 110 facilitates the ease of installation since each of the separate sections can be individually placed within the counterweight 70 prior to attachment to each other to form the splash shield 110. The multi-section splash shield 110 is also required due to the geometry of the counterweight 70. Specifically, the top opening of the counterweight 70 is smaller in diameter than the diameter of the vertical separating wall 100 that supports the splash shield 110. Thus, forming the splash shield in multiple sections is required in the embodiment illustrated. The splash shield 110 includes a series of outer fasteners 112 that each are received within a bore 114 formed in the vertical separating wall 100. A series of inner fasteners 116 are used to attach the separate sections that form the splash shield 110.

Although a series of inner fasteners 116 are illustrated to attach the separate sections of the splash shield 110, it is contemplated that other attachment methods could be utilized while operating within the scope of the present disclosure. As an example, the splash shield sections could be joined using other types of hardware, welding or attachment methods. Additionally, although the embodiment illustrates mounting the splash shield sections to the vertical separated wall 100, it is contemplated that the vertical separating wall and splash shield sections could be integrally molded and the integrally molded piece would be bolted to the horizontal floor 84.

When the splash shield 110 is mounted to the vertical separating wall 100, an outer end 118 of the splash shield is generally aligned with the outermost surface of the vertical separating wall 100. An inner end 120 of the splash shield 110 extends radially inward, as shown in FIG. 9. As can be understood in FIG. 9, the inner end 120 is spaced radially inward from the inner edge 86 of the floor 84. The combination of the floor 84, the vertical separating wall 100 and the splash shield 110 define an inner oil chamber 122.

As further illustrated in FIG. 9, the inner wall 102, the splash shield 110 and the vertical separating wall 100 combine to define an outer oil chamber 124. The inner and outer oil chambers are thus separated by the vertical separating wall 100 and the splash shield 110. The outer oil chamber 124 includes an open upper end 126 that allows oil to enter into the outer oil chamber 124, as will be described.

Figure 11:
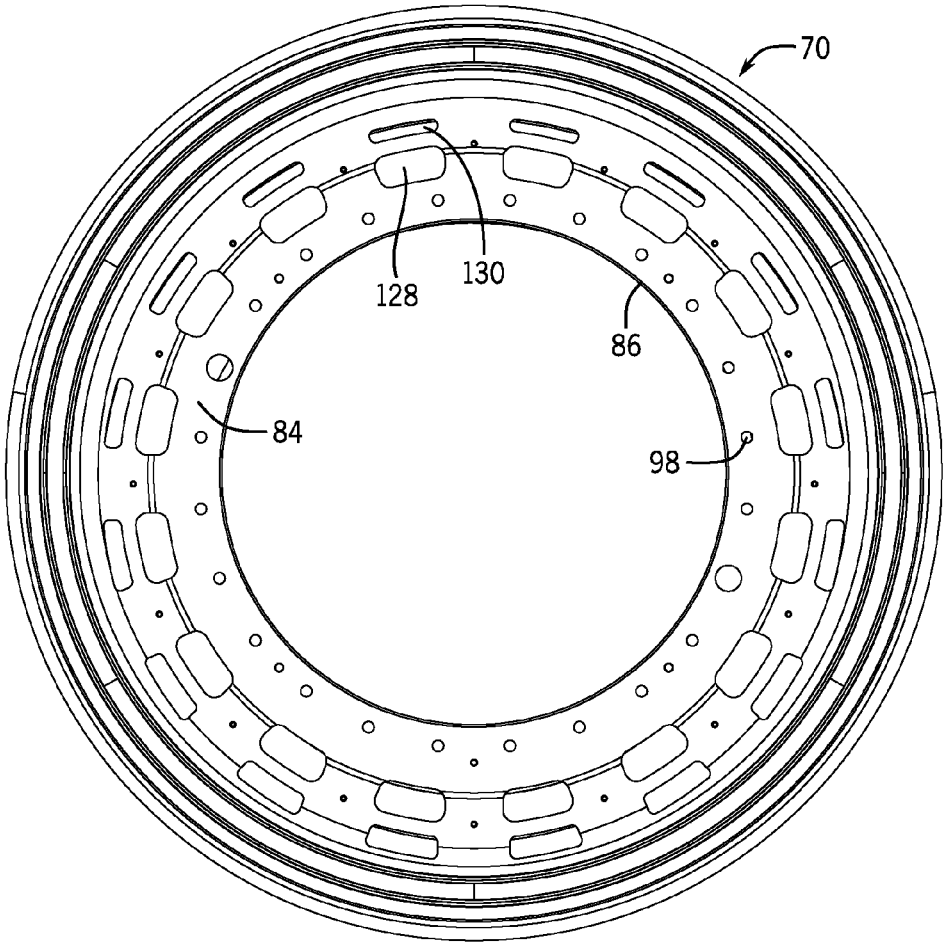
FIG. 11 is a bottom view of the counterweight.

Referring now to FIGS. 9 and 11, the floor 84 of the counterweight 70 includes a series of drain holes that allow oil to pass through the floor and be drained out of the cone crusher. Specifically, the floor includes a series of spaced inner chamber drain holes 128 and a second series of outer chamber drain holes 130. The inner and outer chamber drain holes 128, 130 are located on opposite sides of the vertical separating wall 100, as best shown in FIG. 8. The inner chamber drain holes 128 allow oil accumulated within the inner oil chamber 122 to drain through the counterweight while the outer chamber drain holes 130 allows oil accumulated within the outer oil chamber to also drain through the counterweight 70. Although the inner and outer oil chamber drain holes 128, 130 are shown in FIG. 9 as being generally aligned with each other and separated by solid divider 131, it should be understood that the spacing between the inner chamber drain holes 128 and the outer chamber drain holes 130 could be varied while operating within the scope of the present disclosure.

Figure 3:
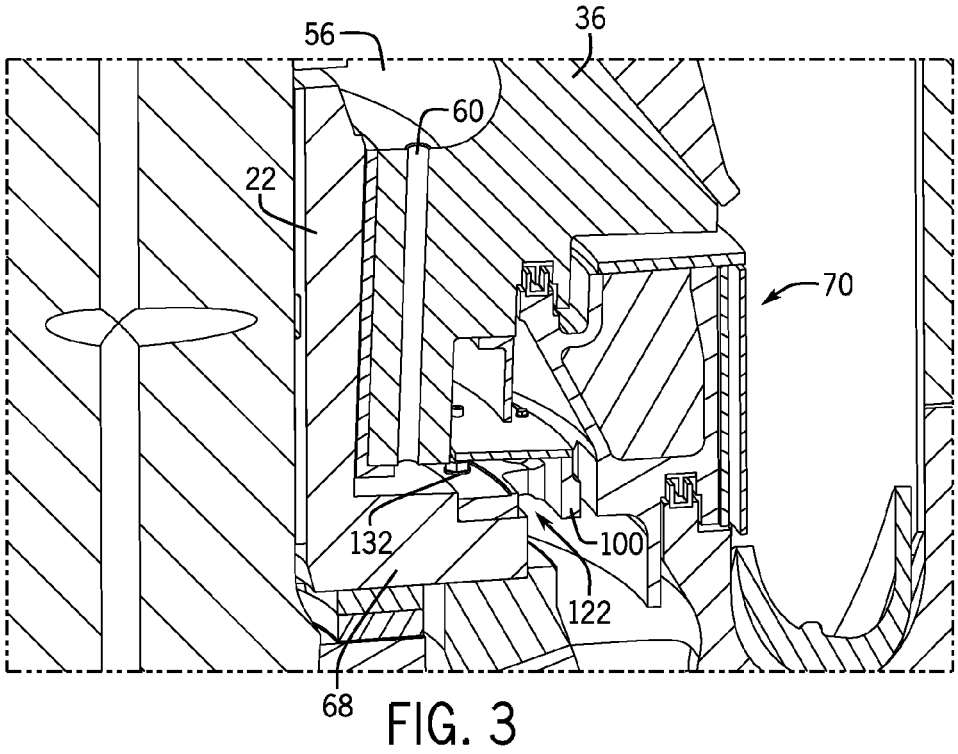
FIG. 3 is a further magnified view illustrating the inner and outer oil chambers created by the counterweight of the present disclosure.
Figure 4:
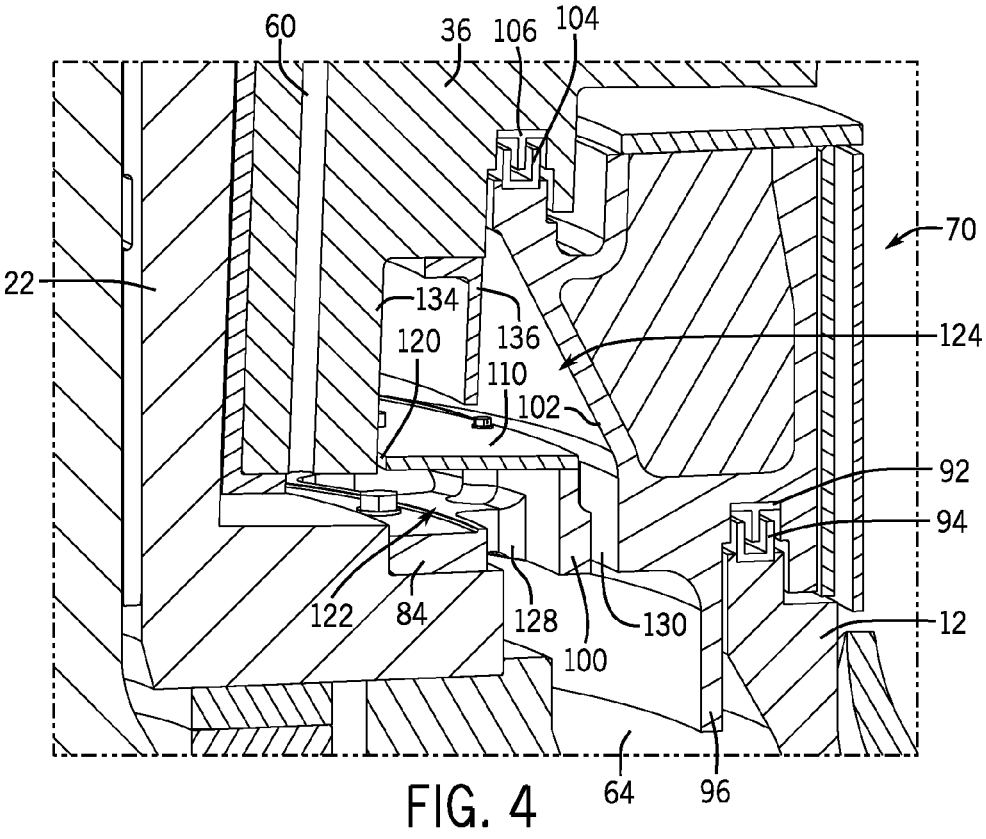
FIG. 4 is a further magnified view similar to FIG. 3.

FIGS. 3 and 4 illustrate the position of the counterweight 70 relative to the crushing head 36 along the thin side of the eccentric 22. As discussed previously, the drain holes 60 deposit oil collected from the upper sump 56 onto the radial flange 68 of the eccentric 22 and the horizontal floor of the counterweight 84. The counterweight 70 is attached to the radial flange 68 through the series of fasteners 132. In this position, the inner oil chamber 122 receives the oil from the drain holes 60 that is flung radially outward by the rotating eccentric 22.

As illustrated in FIG. 4, the inner end 120 of the splash shield 110 is very closely spaced relative to the surface 134 of the crushing head 36. The close spacing between the inner end 120 of the splash shield 110 and the surface 134 greatly restricts the amount of oil that can splash over the splash shield 110. As stated previously, the inner oil chamber is generally defined by the splash shield 110, the floor 84 and the vertical separating wall 100. During operation, oil flung radially outward by the rotating eccentric 22 is entrapped within the inner oil chamber 122 and quickly drains through the series of inner chamber drain holes 128. Since the oil is forced radially outward by the centrifugal force created by the rotating eccentric 22, the inner chamber dram oil holes 128 are positioned as close as possible to the vertical separating wall 100 to prevent oil from pooling within the inner oil chamber 122. The oil drained through the inner chamber drain holes 128 passes through the counterweight and is ultimately collected within the main frame oil sump 64.

During high speed operation of the cone crusher, the eccentric 22 is rotating at a relatively high speed which causes oil being drained through the drain holes 60 to be thing into the inner oil chamber 122. This oil can create very small particles of oil or a mist that may not be entrapped and contained within the inner oil chamber 122. This additional oil is then received within the outer oil chamber 124. The outer oil chamber 124 is defined as the area above the splash shield 110 and between the vertical separating wall 100 and the inner wall 102 of the counterweight 70. Any oil received within the outer oil chamber 124 collects and is drained out of the outer oil chamber through the outer chamber drain holes 130. As described above, since the eccentric 22 is rotating, any oil received within the outer oil chamber 124 is forced radially outward through the centrifugal force created by the rotating eccentric. Thus, the outer chamber drain holes 130 are positioned adjacent the inclined inner wall 102 of the counterweight 70 to help eliminate pooling of the oil within the counterweight. The oil drained through the outer chamber drain holes 130 is also directed to the main frame oil sump 64 by the vertical flange 96. The flange 96 protects the lower seal formed between the T-seal 92 mounted to the counterweight and the U-seal 94 mounted to the main flame 12.

As illustrated in FIG. 4, a head skirt 136 is mounted to the crushing head 36 to further deflect oil away from the seal created by the U-seal 104 and the T-seal 106. The head skirt 136 is attached to the crushing head 36 through a series of spaced connectors, such as bolts. Although the head skirt 136 deflects the oil-air mist away from the seals 104, 106, the head skirt 136 may not be required depending upon the close spacing between the inner end 120 of the splash shield 110 and the surface 134 of crushing head 36, which controls how much oil enters the outer oil chamber 124 and the direction and velocity at which the oil enters the outer oil chamber 124.

FIG. 5 illustrates the general flow of lubricating oil within both the inner oil chamber 122 and the outer oil chamber 124. As previously described, lubricating oil from the drain hole 60 contacts the radial flange 68 of the eccentric 22 and the floor 84 of the counterweight and enters into the inner oil chamber 122. The oil within the inner chamber 122 is entrapped by the generally horizontal splash shield 110 and the vertical separating wall 100. This collected oil drains through the inner chamber drain holes 128 and ultimately travels to the main frame oil sump. Although most of this oil is captured in the inner oil chamber 122, an oil-air mist may pass between the slight gap formed between the inner end 120 of the splash shield 110 and the surface 134. This oil mist contacts the head skirt 136 and is directed downward onto the upper surface of the splash shield 110. The rotational movement of the eccentric and counterweight cause this small amount of oil to be flung radially outward and into contact with the inclined inner wall 102. The oil quickly drains out through the outer chamber drain holes 130 positioned on the opposite side of the vertical separating wall 100 from the inner chamber drain holes 128. In this manner, the oil from both the inner chamber drain holes 128 and the outer chamber drain holes 130 move toward the main frame oil sump.

Figure 6:
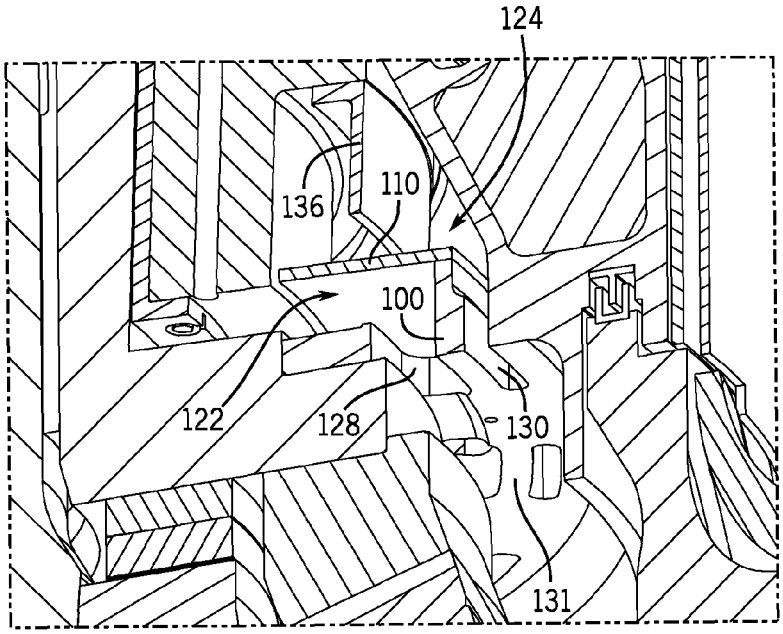
FIG. 6 is a bottom section view illustrating the oil in both the inner oil chamber and the outer oil chamber.

FIG. 6 clearly illustrates the position of the outer chamber drain holes 130 and the inner chamber drain holes 128 on the opposite sides of the vertical separating wall 100. The lower portion of the vertical separating wall 100 forms the divider 131 between the drain holes 128 and 130. Further, FIG. 6 illustrates the separation between the inner oil chamber 122 and the outer oil chamber 124.

Figure 7:
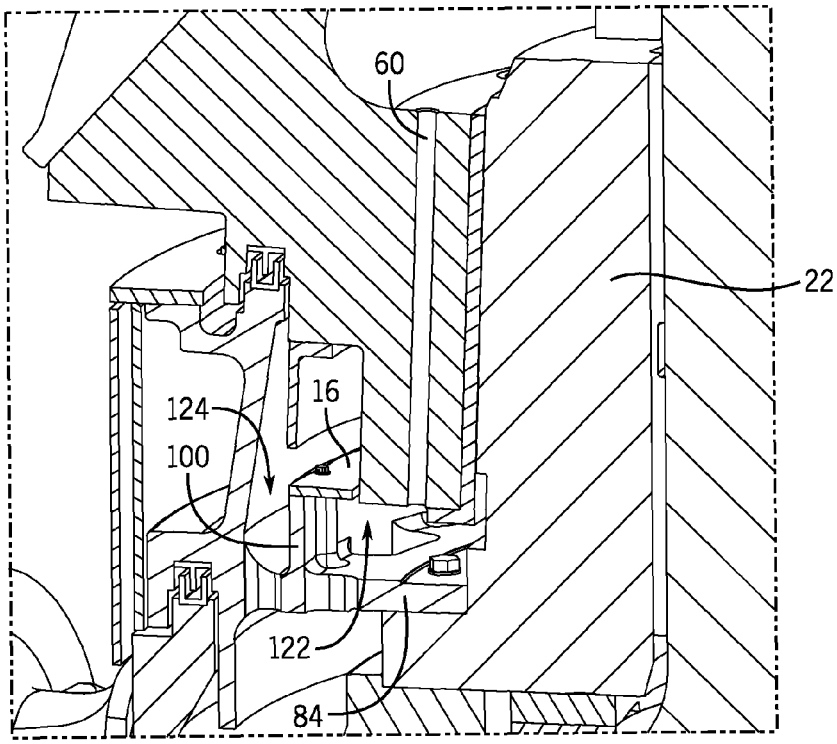
FIG. 7 illustrates the inner and outer oil chambers aligned with the thick side of the eccentric.

FIG. 7 illustrates the inner and outer chambers relative to the thick side of the eccentric 22. As illustrated in FIG. 7, the radial width of the splash plate 110 is less at the location aligned with the thick portion of the eccentric as compared to the thin portion of the eccentric shown in FIG. 3 due to the increased eccentric thickness. However, the splash shield 110 still combines with the vertical separating wall 100 to define the inner oil chamber 122. The outer oil chamber 124 is positioned on an opposite side of the vertical separating wall 100. Oil from drain holes 60 in this position drops directly onto the horizontal counterweight floor 84.

Figure 12:
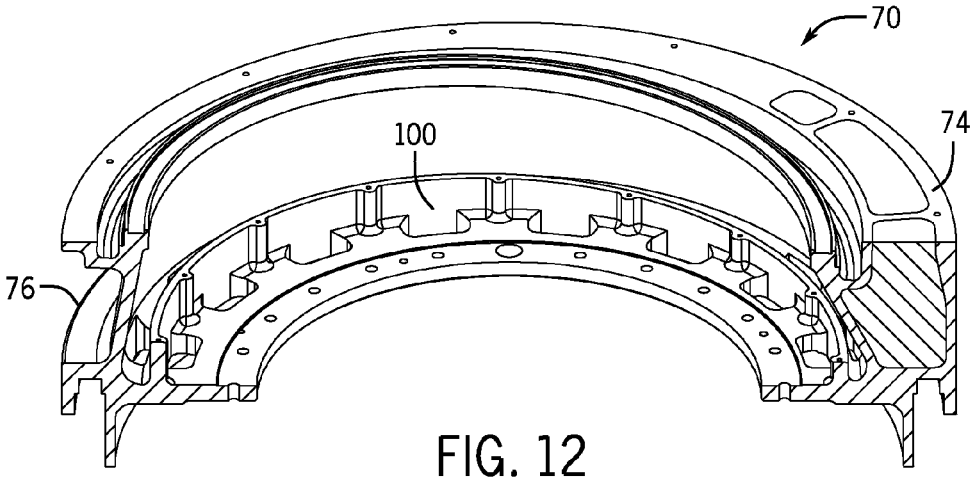
FIG. 12 is a partial section view with the splash plate removed.

FIG. 12 illustrates that the height of the vertical separating wall 100 changes from the heavy side 74 to the light side 76 of the counterweight 70. Since the heavy side 74 of the counterweight 70 is aligned with the thin side of the eccentric, the height of the vertical separating wall 100 changes to accommodate the configuration of the eccentric and the resulting position of the head.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A cone crusher comprising:

a stationary bowl;

a head assembly positioned for movement within the stationary bowl to create a crushing, gap between the stationary bowl and the head assembly, the head assembly including a crushing head;

an eccentric assembly rotatable about a main shaft to impart movement to the head assembly; and a counterweight mounted to the eccentric assembly for rotation with the eccentric assembly, the counterweight having an inner oil chamber and an outer oil chamber separated by a vertical separating wall.

2. The cone crusher of claim 1 wherein the inner and outer oil chambers each include a horizontal floor, wherein the vertical separating wall extends from the floor.

3. The cone crusher of claim 2 wherein the inner oil chamber includes a plurality of spaced inner chamber drain holes and the outer oil chamber includes a plurality of spaced outer chamber drain holes.

4. The cone crusher of claim 2 further comprising a splash shield mounted to the vertical separating wall and positioned to overhang at least a portion of the horizontal floor in the inner oil chamber.

5. The cone crusher of claim 4 wherein the splash shield is continuous over 360°.

6. The cone crusher of claim 5 wherein the splash shield is formed from a plurality of shield . plates each separately attached to the separating wall.

7. The cone crusher of claim 4 wherein the splash shield includes an inner end closely spaced from the head assembly and an outer end attached to the separating wall.

8. The cone crusher of claim 7 wherein the outer oil chamber is defined by the separating wall, the splash shield and a counterweight inside wall, wherein the outer end of the splash shield is spaced from the counterweight inside wall such that the outer oil chamber is open opposite the horizontal floor.

9. The cone crusher of claim 4 further comprising a head skirt depending from the crushing head and positioned above the splash shield.

10. The cone crusher of claim 1 wherein the crushing head of the assembly includes plurality of head drain holes that are each in fluid communication with the inner oil chamber.

11. The cone crusher of claim 1 further comprising an oil lubrication system operable to deliver lubricating oil within the head assembly, wherein the plurality of head drain holes receives at least a portion of the lubricating oil.

12. A cone crusher comprising:

a stationary bowl;

a head assembly positioned for gyrational movement within the stationary bowl to create a variable crushing gap with the stationary bowl, the head assembly including a crushing head;

an eccentric assembly rotatable about a main shaft to impart gyrational movement to the head assembly within the bowl;

a counterweight mounted to the eccentric assembly for rotation with the eccentric assembly, the counterweight including a vertical separating wall extending from a horizontal floor to define and separate an inner oil chamber and an outer oil chamber; and a splash shield having a radial outer end mounted to the vertical separating wall such that the splash shield overhangs at least a portion of the horizontal floor to further separate the inner oil chamber and the outer oil chamber.

13. The cone crusher of claim 12 wherein the splash shield includes an inner end positioned adjacent to the crushing head of the head assembly.

14. The cone crusher of claim 13 wherein the outer oil chamber is defined by the separating wall, the splash shield and a counterweight inside all wherein the outer end of the splash shield is spaced from the counterweight inside wall such that the outer oil chamber is open opposite the horizontal floor.

15. The cone crusher of claim 12 wherein the splash shield is formed from a plurality of individual shield plates each attached to the separating wall.

16. The cone crusher of claim 15 wherein the splash shield is continuous and extends 360°.

17. The cone crusher of claim 12 wherein the inner oil chamber includes a plurality of spaced inner chamber drain holes and the outer oil chamber includes a plurality of spaced outer chamber spaced drain holes.

18. A counterweight for use with a cone crusher, the counterweight comprising:

a horizontal floor extending between an inner edge and an outer edge;

a vertical separating wall extending horn the horizontal floor and positioned between the outer edge and the inner edge of the floor;

a splash shield having a radial outer end mounted to the vertical separating wall and an inner end extending toward the inner edge of the floor to define an inner oil chamber;

an inner wall extending from the floor and positioned radially outward from the vertical separating wall, wherein the inner wall, the splash shield and the vertical separating wall define an outer oil chamber;

a plurality of spaced inner chamber drain holes extending through the floor and positioned within the inner oil chamber; and a plurality of spaced outer chamber drain holes extending through the floor and positioned in the outer oil chamber.

19. The counterweight of claim 18 wherein the splash shield is formed from a plurality of shield plates each separately attached to the separating wall.

20. The counterweight of claim 19 wherein the splash shield is continuous and extends 360°.

* * * * *